US011603572B2

(12) United States Patent
Ko et al.

(10) Patent No.: US 11,603,572 B2
(45) Date of Patent: Mar. 14, 2023

(54) GRAIN-ORIENTED ELECTRICAL STEEL SHEET AND METHOD FOR MANUFACTURING SAME

(71) Applicant: POSCO, Pohang-si (KR)

(72) Inventors: Kyung-Jun Ko, Pohang-si (KR); Hyung Don Joo, Pohang-si (KR); Sang-Woo Lee, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 17/280,522

(22) PCT Filed: Sep. 25, 2019

(86) PCT No.: PCT/KR2019/012474
§ 371 (c)(1),
(2) Date: Apr. 29, 2021

(87) PCT Pub. No.: WO2020/067724
PCT Pub. Date: Apr. 2, 2020

(65) Prior Publication Data

US 2022/0042123 A1 Feb. 10, 2022

(30) Foreign Application Priority Data

Sep. 27, 2018 (KR) ..... 10-2018-0115266

(51) Int. Cl.
*C22C 38/18* (2006.01)
*C21D 8/12* (2006.01)

(52) U.S. Cl.
CPC ..... *C21D 8/1222* (2013.01); *C21D 8/1233* (2013.01); *C21D 8/1255* (2013.01); *C21D 8/1272* (2013.01); *C21D 2201/05* (2013.01)

(58) Field of Classification Search
CPC ..... C21D 8/12; C21D 9/46; C21D 2201/05
See application file for complete search history.

(56) References Cited

U.S. PATENT DOCUMENTS

| | | | | |
|---|---|---|---|---|
| 6,103,022 | A * | 8/2000 | Komatsubara | C21D 8/12 420/117 |
| 2012/0131982 | A1* | 5/2012 | Imamura | C22C 38/06 72/362 |
| 2013/0306202 | A1 | 11/2013 | Joo et al. | |
| 2014/0031169 | A1 | 1/2014 | Kuang et al. | |
| 2015/0302962 | A1* | 10/2015 | Yang | H01F 1/18 148/307 |

FOREIGN PATENT DOCUMENTS

| | | | | |
|---|---|---|---|---|
| CN | 103834856 | A | 6/2014 | |
| CN | 107109508 | A | 8/2017 | |
| CN | 107460293 | A | 12/2017 | |
| CN | 108474055 | A | 8/2018 | |
| EP | 2924139 | A1 | 9/2015 | |
| EP | 3196320 | A1 | 7/2017 | |
| JP | 60059045 | A * | 4/1985 | C21D 8/1233 |
| JP | H02-274813 | A | 11/1990 | |
| JP | H04-329831 | A | 11/1992 | |
| JP | H05-78743 | A | 3/1993 | |
| JP | H07-62440 | A | 3/1995 | |
| JP | H07-305116 | A | 11/1995 | |
| JP | H10-183312 | A | 7/1998 | |
| JP | 2016-505706 | A | 2/2016 | |
| JP | 6191780 | B2 | 8/2017 | |
| JP | 6209998 | B2 | 9/2017 | |
| JP | 6209999 | B2 | 9/2017 | |
| KR | 10-1998-024214 | A | 7/1998 | |
| KR | 10-2009-0072116 | A | 7/2009 | |
| KR | 10-2013-0071968 | A | 7/2013 | |
| KR | 10-1353549 | B1 | 1/2014 | |
| KR | 10-1614593 | B1 | 4/2016 | |
| KR | 10-2017-0010445 | A | 1/2017 | |
| KR | 10-2018-0072107 | A | 6/2018 | |
| KR | 10-2018-0074455 | A | 7/2018 | |
| WO | 2016/035345 | A1 | 3/2016 | |
| WO | 2018117639 | A8 | 6/2018 | |
| WO | 2018117671 | A1 | 6/2018 | |

OTHER PUBLICATIONS

Extended European Search Report dated Oct. 21, 2021 issued in European Patent Application No. 19864724.0.
Japanese Office Action dated Apr. 26, 2022 issued in Japanese Patent Application No. 2021-517632.
International Search Report and Written Opinion issued in corresponding International Application No. PCT/KR2019/012474 dated Jan. 15, 2020, with partial English translation.

* cited by examiner

*Primary Examiner* — Vanessa T. Luk

(74) *Attorney, Agent, or Firm* — Morgan, Lewis & Bockius LLP

(57) ABSTRACT

A method for manufacturing a grain-oriented electrical steel sheet according to an embodiment of the present invention comprises: a step for hot-rolling a slab to produce a hot-rolled sheet; a step for cold-rolling the hot-rolled sheet to produce a cold-rolled sheet; a step for subjecting the cold-rolled sheet to primary recrystallization annealing; and a step for subjecting the primary recrystallization annealing-completed cold-rolled sheet to secondary recrystallization annealing, wherein the primary recrystallization annealing step includes a preceding step and a subsequent step, and the amount (A) of nitriding gas introduced in the preceding step with respect to the total amount (B) of nitriding gas introduced in the primary recrystallization annealing step satisfies expression 1 below.

$$0.05 \leq [A]/[B] \leq [t] \quad \text{[Expression 1]}$$

(In expression 1, the amount of nitriding gas introduced is in units of $Nm^3/hr$, and [t] represents the thickness (mm) of a cold-rolled sheet.)

2 Claims, No Drawings

GRAIN-ORIENTED ELECTRICAL STEEL SHEET AND METHOD FOR MANUFACTURING SAME

CROSS REFERENCE

This application is the U.S. National Phase under 35 U.S.C. § 371 of International Application No. PCT/KR2019/012474 filed on Sep. 25, 2019, which claims the benefit of Korean Patent Application No. 10-2018-0115266 filed on Sep. 27, 2018, the entire contents of each are hereby incorporated by reference.

TECHNICAL FIELD

An exemplary embodiment of the present invention relates to a grain-oriented electrical steel sheet and a method for manufacturing a grain-oriented electrical steel sheet. Specifically, an exemplary embodiment of the present invention relates to a grain-oriented electrical steel sheet which improves magnetic characteristics by controlling the ratio of the number of crystal grains having a small particle diameter to the number of crystal grains having a large particle diameter, and a method for manufacturing a grain-oriented electrical steel sheet.

BACKGROUND ART

A grain-oriented electrical steel sheet is used as an iron core material for a stopping device such as a transformer, an electric motor, a generator, and other electronic devices. A grain-oriented electrical steel sheet final product has a texture in which the orientation of the crystal grains is oriented in the (110) [001] direction (or (110)<001> direction), and has excellent magnetic properties in the rolling direction. For this reason, the grain-oriented electrical steel sheet may be used as an iron core material for a transformer, an electric motor, a generator, other electronic devices, and the like. Low iron loss is required to reduce energy loss, and high magnetic flux density is required to reduce the size of power generation equipment.

The iron loss of a grain-oriented electrical steel sheet is divided into hysteresis loss and eddy current loss, and, efforts such as increasing the inherent resistivity and reducing the thickness of a product sheet are required to reduce the eddy current loss among them. There is also difficulty in having to roll a grain-oriented electrical steel sheet, which is a product that is difficult to roll, into an ultra-thin material in a direction to reduce the thickness of the product sheet, but a problem which is the biggest difficulty and needs to be overcome in making an ultra-thin material product with the highest standard is to very strongly maintain the degree of directness in the Goss orientation, which is a secondary recrystallized structure of a grain-oriented electrical steel sheet.

When looking at the problems in rolling during the manufacture of an ultra-thin material product, it is known that during the manufacture of a grain-oriented electrical steel sheet which is subjected to a low-temperature heating method and a one-time steel cold rolling process, an optimal reduction ratio is typically within 90%. Accordingly, in order to manufacture a 0.20 mm or less ultra-thin material product, hot rolling is required with a hot-rolled sheet thickness of 2.0 mm or less to secure a 90% cold rolling ratio. The thinner the hot-rolled thickness is, the higher reduction ratio is required, and productivity deteriorates for reasons such as the maintenance of hot-rolling temperature and the shape of an edge part of a hot-rolled sheet such as an edge scab, a coil tower, and a tail part.

A more important problem is that as a product becomes thinner, it becomes difficult to strongly maintain the degree of directness in the Goss orientation due to the rapid loss of precipitates from the surface particularly in an interval where the secondary recrystallization of Goss orientation appears during the secondary recrystallization annealing process. This is a problem that is directly related to the magnetic characteristics of a product, and it is difficult to secure the highest-grade magnetic characteristics in an ultra-thin material product, which should be overcome by the present invention.

As a method of overcoming the loss of precipitates, a method of preventing the loss of precipitates by increasing the fraction of $N_2$ gas during the secondary recrystallization annealing process has been proposed, but there is a problem of inducing defects such as nitrogen outlets on the surface of a product sheet.

To solve this problem, an economical manufacturing method using a simultaneous decarburization nitridation method has also been proposed. It was clarified that there was a difference between a surface crystal grain diameter and a core layer crystal grain diameter when a decarburized sheet is manufactured by the simultaneous decarburization nitridation method, and it was proposed that the difference needs to be controlled within a certain range.

Further, in order to solve this problem, a technique for dramatically improving magnetism by containing segregation elements such as Sb, P, and Sn has been proposed. When an ultra-thin material product is manufactured by further adding a segregation element, the segregation element has been used as an auxiliary inhibitor which compensates for the loss of precipitates, but when an excessive amount of segregation element is added, it is difficult to perform ultra-thin rolling and when an excessive amount of segregation element is added, an oxidized layer is non-uniform and becomes thin, so that because there is a side effect of further causing the loss of precipitates due to deterioration in characteristics of a base coating, the magnetism cannot be stably secured.

In addition, in order to solve this problem, a method of adjusting the oxidizing ability and nitriding treatment of a front end portion in the primary recrystallization annealing process at the time of manufacturing an ultra-thin material product has also been proposed. However, there is a problem in that an effect of the loss of the precipitate becomes extremely sensitive in the manufacture of an ultra-thin material product.

DISCLOSURE

Technical Problem

The present invention has been made in an effort to provide a grain-oriented electrical steel sheet and a method for manufacturing a grain-oriented electrical steel sheet. Specifically, the present invention has been made in an effort to provide a grain-oriented electrical steel sheet which improves magnetic characteristics by controlling the ratio of the number of crystal grains having a small particle diameter to the number of crystal grains having a large particle diameter, and a method for manufacturing a grain-oriented electrical steel sheet.

Technical Solution

A method for manufacturing a grain-oriented electrical steel sheet according to an exemplary embodiment of the present invention includes: a step for hot-rolling a slab to produce a hot-rolled sheet; a step for cold-rolling the hot-rolled sheet to produce a cold-rolled sheet; a step for subjecting the cold-rolled sheet to primary recrystallization annealing; and a step for subjecting the primary recrystallization annealing-completed cold-rolled sheet to secondary recrystallization annealing, wherein the primary recrystallization annealing step includes a preceding step and a subsequent step, and the amount (A) of nitriding gas introduced in the preceding step with respect to the total amount (B) of nitriding gas introduced in the primary recrystallization annealing step satisfies expression 1 below.

$$0.05 \leq [A]/[B] \leq [t] \quad \text{[Expression 1]}$$

(In expression 1, the amount of nitriding gas introduced is in units of $Nm^3/hr$, and [t] represents the thickness (mm) of a cold-rolled sheet.)

A slab may include 0.03 to 0.15 wt % of Cr.

The slab may further include 0.1 wt % or less of Ni.

The slab may further include a combined amount of 0.03 to 0.15 wt % of Sn and Sb, and 0.01 to 0.05 wt % of P.

The slab may include 2.5 to 4.0 wt % of Si, 0.03 to 0.09 wt % of C, 0.015 to 0.040 wt % of Al, 0.04 to 0.15 wt % of Mn, 0.001 to 0.006 wt % of N, 0.01 wt % or less of S, 0.03 to 0.15 wt % of Cr, the balance Fe and other impurities that are inevitably mixed.

The method may further include a step for heating the slab at 1280° C. or less prior to the step for producing a hot-rolled sheet.

The nitriding gas may include one or more of ammonia and amine.

The time to perform a preceding step may be 10 to 80 seconds, and the time to perform a subsequent step may be 30 to 100 seconds.

The preceding step and the subsequent step may be performed at a temperature of 800 to 900° C.

The preceding step and the subsequent step may be performed in an atmosphere having an oxidizing ability ($PH_2O/PH_2$) of 0.5 to 0.7.

After the primary recrystallization annealing, the steel sheet may include 0.015 to 0.025 wt % of nitrogen.

After the primary recrystallization annealing, the steel sheet may satisfy the following expression 2.

$$1 \leq [G_{1/4t}] - [G_{1/2t}] \leq 3 \quad \text{[Expression 2]}$$

(In expression 2, $[G_{1/4t}]$ means an average crystal grain diameter (μm) measured at a ¼ point of the total thickness of the steel sheet, and $[G_{1/2t}]$ means an average crystal grain diameter (μm) measured at a ½ point of the total thickness of the steel sheet.)

After the primary recrystallization annealing, the steel sheet may satisfy the following Expression 3.

$$0.003 \leq [N_{tot}] - [N_{1/4t-3/4t}] \leq 0.01 \quad \text{[Expression 3]}$$

(In expression 3, $[N_{tot}]$ means a nitrogen content (wt %) of the entire steel sheet, and $[N_{1/4t-3/4t}]$ means a nitrogen content (wt %) at ¼ to ¾ points of the total thickness of the steel sheet.)

A grain-oriented electrical steel sheet according to an exemplary embodiment of the present invention may satisfy the following Expression 4.

$$[D_s]/[D_L] \leq 0.1 \quad \text{[Expression 4]}$$

(In expression 4, $[D_s]$ represents the number of crystal grains having a particle diameter of 5 mm or less, and $[D_L]$ represents the number of crystal grains having a particle diameter of more than 5 mm.)

The steel sheet may include 0.03 to 0.15 wt % of Cr.

The magnetism of the grain-oriented electrical steel sheet according to an exemplary embodiment of the present invention may be improved by dividing the nitriding process in the primary recrystallization annealing step during the production process into two steps to perform the nitriding process.

The magnetism of the grain-oriented electrical steel sheet according to an exemplary embodiment of the present invention may be improved by uniformly controlling the particle diameter of crystal grains over the entire thickness range with respect to the steel sheet and controlling the amount of nitriding over the thickness, after the primary recrystallization annealing.

The grain-oriented electrical steel sheet according to an exemplary embodiment of the present invention may improve magnetic characteristics by controlling the ratio of the number of crystal grains having a small particle diameter to the number of crystal grains having a large particle diameter.

MODE FOR INVENTION

Terms such as first, second, and third are used to describe various parts, components, regions, layers, and/or sections, but are not limited thereto. These terms are used only to distinguish one part, component, region, layer or section from another part, component, region, layer or section. Therefore, a first part, component, region, layer or section described below may be referred to as a second part, component, region, layer or section within the scope of the present invention.

The terminology used herein is merely for reference to specific embodiments and is not intended to limit the invention. The singular forms used herein also include the plural forms unless the phrases do not express the opposite meaning explicitly. As used herein, the meaning of "include" specifies a specific feature, region, integer, step, action, element and/or component, and does not exclude the presence or addition of a different specific feature, region, integer, step, action, element, and/or component.

If a part is referred to as being "above" or "on" another part, it may be directly above or on another part or may be accompanied by another part therebetween. In contrast, when it is mentioned that a part is "directly above" another part, no other part is interposed therebetween. Unless otherwise defined, all terms including technical terms and scientific terms used herein have the same meaning as commonly understood by those skilled in the art to which the present invention pertains. Commonly used predefined terms are further construed to have meanings consistent with the relevant technical literature and the present disclosure and are not to be construed as ideal or very formal meanings unless defined otherwise.

Further, unless otherwise specified, % means wt %, and 1 ppm is 0.0001 wt %.

In an exemplary embodiment of the present invention, further including an additional element means that an additional amount of the additional element is included by being substituted for the balance iron (Fe).

Hereinafter, examples of the present invention will be described in detail such that those having ordinary skill in the art to which the present invention pertains can easily carry out the examples. As those skilled in the art would realize, the described embodiments may be modified in various different ways, all without departing from the spirit or scope of the present invention.

A method for manufacturing a grain-oriented electrical steel sheet according to an exemplary embodiment of the present invention includes: a step for hot-rolling a slab to produce a hot-rolled sheet; a step for cold-rolling the hot-rolled sheet to produce a cold-rolled sheet; a step for subjecting the cold-rolled sheet to primary recrystallization annealing; and a step for subjecting the primary recrystallization annealing-completed cold-rolled sheet to secondary recrystallization annealing.

Hereinafter, each step will be described in detail.

First, a hot-rolled sheet is produced by hot-rolling a slab.

An exemplary embodiment of the present invention is characterized by a flow rate of a nitriding gas in a primary recrystallization annealing process, crystal grains after the primary recrystallization annealing, nitriding amount characteristics, and proportion of crystal grains depending on the size after a secondary recrystallization annealing, and as an alloy composition, it is possible to use an alloy composition in a generally known grain-oriented electrical steel sheet. Supplementarily, slab alloy components will be described.

A slab may include 0.03 to 0.15 wt % of Cr.

Cr: 0.03 to 0.15 wt %

Chromium (Cr) is an element that promotes oxidation formation. Addition of an appropriate amount of chromium suppresses formation of a dense oxide layer in a surface layer portion and helps to form a fine oxide layer in a depth direction. The addition of Cr may add effects of overcoming a phenomenon in which decarburization and nitridation are delayed and the primary recrystallized grains become non-uniform, forming primary recrystallized grains with excellent uniformity, and improving magnetism and surface. When an appropriate amount of Cr is added, the internal oxide layer is formed deeper and the nitridation and decarburization rates are increased, so that it is possible to overcome the difficulty of adjusting the size and securing the uniformity of the primary recrystallized grains. Further, a base coating formed during the secondary recrystallization annealing process may be robustly formed. When the content of CR is less than the lower limit, the effect is weak, and when the content of CR exceeds the upper limit, an oxide layer may be excessively formed, so that the effect may be reduced. More specifically, Cr may be included in an amount of 0.05 to 0.1 wt %.

The slab may further include 0.1 wt % or less of Ni.

Ni: 0.1 wt % or less

Like C, nickel (Ni) is an austenite-forming element, and brings about a structure micronization effect by activating austenite phase transformation in a heat treatment process after hot rolling and hot rolling. In particular, nickel has an effect of promoting the formation of Goss crystal grains in the sub-surface layer portion, and thus brings about an effect of enhancing the magnetic flux density of a final product by increasing the Goss fraction and improving the uniformity of the size of primary recrystallized grains. In addition, the base coating may be robustly formed similarly to Cr by further adding Ni. The effect may be strengthened by simultaneously adding Ni together with Cr. More specifically, Ni may be included in an amount of 0.005 to 0.05 wt %. The slab may further include a combined amount of 0.03 to 0.15 wt % of Sn and Sb, and 0.01 to 0.05 wt % of P.

A combined amount of Sn and Sb: 0.03 to 0.15 wt %

Tin (Sn) and antimony (Sb) are known as crystal growth inhibitors because these elements are intergranular segregation elements and elements that hinder the movement of grain boundaries. Furthermore, since the number of Goss orientation nuclei growing into a secondary recrystallization texture is increased by increasing the fraction of Goss orientation crystal grains in a primary recrystallization texture, the size of the secondary recrystallization microstructure is decreased. The smaller the crystal grains is, the smaller the eddy current loss is, so that the iron loss of a final product decreases. When the combined amount of Sn and Sb is too small, there is no addition effect. When the combined amount is too large, the crystal grain growth inhibitory force increases so much that the crystal grain size of the primary recrystallization microstructure needs to be reduced in order to relatively increase the driving force for crystal grain growth, and thus, decarbonization annealing needs to be performed at a low temperature, which makes it impossible to secure a good surface because the combined amount cannot be controlled into an appropriate oxide layer. More specifically, Sn and Sb may be included in an amount of 0.02 to 0.08 wt % and 0.01 to 0.08 wt %, respectively.

P: 0.01 to 0.05 wt %

Phosphorus (P) is an element that exhibits an effect similar to Sn and Sb, and can play an auxiliary role in segregating at the crystal grain boundaries to hinder the movement of the grain boundaries and simultaneously suppressing the growth of crystal grains. Further, phosphorus has an effect of improving the {110}<001> texture in terms of the microstructure. When the content of P is too low, there is no addition effect, and when P is added too much, brittleness may increase, so that the rollability may significantly deteriorate. More specifically, P may be included in an amount of 0.015 to 0.03 wt %.

The slab may include 2.5 to 4.0 wt % of Si, 0.03 to 0.09 wt % of C, 0.015 to 0.040 wt % of Al, 0.04 to 0.15 wt % of Mn, 0.001 to 0.006 wt % of N, 0.01 wt % or less of S, 0.03 to 0.15 wt % of Cr, the balance Fe and other impurities that are inevitably mixed.

Si: 2.5 to 4.0 wt %

Silicon (Si) serves to reduce core loss, that is, iron loss by increasing the resistivity of a grain-oriented electrical steel sheet material. When the content of Si is too low, the resistivity decreases, so that iron loss may deteriorate. When Si is excessively contained, the brittleness of steel increases, the toughness decreases, so that the plate breakage rate increases during the rolling process, a load is produced on a cold rolling operation, a plate temperature required for pass aging during cold rolling is not reached, and the formation of secondary recrystallization becomes unstable. Therefore, Si may be included within the above-described range. More specifically, Si may be included in an amount of 3.3 to 3.7 wt %.

C: 0.03 to 0.09 wt %

Carbon (C) is an element that induces the formation of austenite phase. An increase in content of C activates the ferrite-austenite phase transformation during the hot rolling process. Further, as the content of C increases, a long stretched hot-rolled band structure formed during the hot rolling process increases, so that the ferrite grain growth during the hot-rolled sheet annealing process is suppressed. In addition, as the content of C increases, a stretched hot-rolled band structure, which has higher strength than a ferrite structure, increases and initial particles of a hot-rolled sheet annealed structure, which is a cold-rolled initialization structure, become micronized, resulting in improvement in texture after the cold rolling, particularly, an increase in Goss fraction. It is considered that the residual C present in the steel sheet after annealing the hot-rolled sheet increases the pass aging effect during cold rolling, and thus increases the Goss fraction in the primary recrystallized grains. Therefore, a higher content of C may be better, but after that, during decarburization annealing, the decarburization annealing time becomes longer and the productivity is impaired, and when the decarburization at the initial stage of heating is not sufficient, the primary recrystallized crystal grains will be non-uniform, thereby making the secondary recrystallization unstable. Therefore, the content of C in the slab can be adjusted as described above. More specifically, the slab may include 0.04 to 0.07 wt % of C.

As described above, a part of C is removed during the decarburization annealing process in the process of manufacturing a grain-oriented electrical steel sheet, and the content of C in a finally manufactured grain-oriented electrical steel sheet may be 0.005 wt % or less.

Al: 0.015 to 0.04 wt %

Aluminum (Al) forms nitrides in the form of (Al, Si, Mn)N and AlN, and thus serves to strongly inhibit crystal grain growth. When the content is too low, an effect of suppressing the crystal grain growth may not be sufficient because the number of precipitates formed and the volume fraction are low. When the content of Al is too high, precipitates grow coarsely, so that an effect of suppressing the crystal grain growth is reduced. Therefore, Al may be included within the above-described range. More specifically, Al may be included in an amount of 0.02 to 0.035 wt %.

Mn: 0.04 to 0.15 wt %

Manganese (Mn) is an element that reacts with S to form sulfides. When the amount of Mn is too low, fine MnS will be precipitated non-uniformly during hot rolling, so that the magnetic characteristics may deteriorate.

Mn has an effect of reducing iron loss by increasing resistivity in the same manner as in Si. Further, Mn is an element that is important in suppressing the growth of primary recrystallized grains to cause the secondary recrystallization by reacting with nitrogen along with Si to form precipitates of (Al, Si, Mn)N. However, when Mn is excessively added, large amounts of (Fe, Mn) and Mn oxides in addition to $Fe_2SiO_4$ are formed on the surface of the steel sheet, so that because the surface quality deteriorates by hindering the formation of a base coating to be formed during the secondary recrystallization annealing and the non-uniformity of the phase transformation between ferrite and austenite is induced in the primary recrystallization annealing process, the size of primary recrystallized grains becomes non-uniform, and as a result, the secondary recrystallization becomes unstable. Therefore, Mn may be increased within the above-described range. More specifically, Mn may be included in an amount of 0.07 to 0.13 wt %.

N: 0.001 to 0.006 wt %

Nitrogen (N) is an element that reacts with Al and the like to make crystal grains finer. When these elements are properly distributed, as described above, the structure is appropriately made to be fine after cold rolling, which helps to secure an appropriate particle size of primary recrystallization, but when the content is too high, the primary recrystallized grains become excessively fine, and as a result, the fine crystal grains increase the driving force for causing crystal grain growth during the secondary recrystallization, and the grains can grow to crystals in an undesired orientation, which is not preferred. Furthermore, when N is contained in a large amount, the initiation temperature of secondary recrystallization increases to make the magnetic characteristics deteriorate.

In an exemplary embodiment of the present invention, nitridation occurs during the primary recrystallization annealing process, and some nitrogen is removed during the secondary recrystallization annealing process. The content of final residual N may be 0.003 wt % or less.

S: 0.01 wt % or less

Sulfur (S) is an element with a high full solution temperature during hot rolling and severe segregation, and is preferably contained as little as possible, but is one of the impurities inevitably contained during steelmaking. Further, since S affects the size of the primary recrystallized grains by forming MnS, it is preferable to limit the content of S to 0.01 wt % by or less. More specifically, the content of S may be 0.008 wt % or less.

Impurity Elements

In addition to the above elements, impurities that are inevitably incorporated, such as Zr and V may be included. Since Zr, V, and the like are strong carbonitride forming-elements, it is preferred that these elements are not added as much as possible, and each needs to be contained in an amount of 0.01 wt % or less.

A step for heating the slab to 1280° C. or less may be further included prior to the step for producing the hot-rolled sheet. Through this step, the precipitate may be partially dissolved. Further, since the dendritic structure of the slab is prevented from growing coarsely, it is possible to prevent cracks from occurring in a width direction of the sheet in the subsequent hot rolling process, so that an effective yield is improved. When the slab heating temperature is too high, a heating furnace may be repaired due to melting of the surface portion of the slab, and the service life of the heating furnace may be shortened. More specifically, the slab may be heated to 1130 to 1230° C. In the step for producing the hot-rolled sheet, a hot-rolled sheet having a thickness of 1.5 to 3.0 mm may be manufactured by hot rolling.

After the hot-rolled sheet is produced, a step for annealing the hot-rolled sheet may be further included. The step for annealing a hot-rolled sheet may be performed by a process of heating to a temperature of 950 to 1100° C., cracking at a temperature of 850 to 1000° C., and then cooling.

Next, a cold-rolled sheet is produced by cold-rolling the hot-rolled sheet.

Cold rolling may be performed by a strong cold rolling once or by a plurality of passes. The cold-rolled sheet may be produced to have a final thickness of 0.1 to 0.3 mm by giving a pass aging effect through warm rolling at a temperature of 200 to 300° C. at least once during rolling. The cold-rolled sheet is subjected to decarburization and nitridation treatment through recrystallization of a modified structure and a nitriding gas in the primary recrystallization annealing process.

Next, the cold-rolled sheet is subjected to primary recrystallization annealing.

In an exemplary embodiment of the present invention, the primary recrystallization annealing step is divided into a preceding step and a subsequent step, and the amount of nitriding gas introduced in the preceding step and the subsequent step varies.

In this case, the preceding step and the subsequent step are performed in the cracking step among the temperature rising step and the cracking step in the primary recrystallization annealing step.

The preceding step and the subsequent step may be performed in separate crack zones, respectively, or may be performed in a crack zone provided with a blindfold that hinders the flow of nitriding gas to the preceding stage and the subsequent stage.

By appropriately introducing the nitriding gas in the preceding step and the subsequent step, the crystal grains on the surface layer are appropriately grown, and the nitridation into the inside of the steel sheet is smoothly performed, so that the magnetism is finally improved.

Specifically, the amount (A) of nitriding gas introduced in the preceding step with respect to the total amount (B) of nitriding gas introduced satisfies expression 1 below.

$$0.05 \leq [A]/[B] \leq [t] \quad \text{[Expression 1]}$$

(In expression 1, the amount of nitriding gas introduced is in units of $Nm^3$/hr, and [t] represents the thickness (mm) of a cold-rolled sheet.)

When the amount of nitriding gas introduced in the preceding step is too small, nitrogen cannot penetrate into the steel sheet and is present only in the surface layer, causing the magnetism to deteriorate. In contrast, when the amount of nitriding gas introduced in the preceding step is too large, the growth of the crystal grains on the surface layer portion of the steel sheet is greatly suppressed, causing the magnetism to deteriorate.

More specifically, the amount of nitriding gas introduced in the preceding step and the amount of nitriding gas introduced in the subsequent step may be 0.05 to 3 $Nm^3$/hr and 1 to 10 $Nm^3$/hr, respectively.

The nitriding gas can be used without limitation as long as nitrogen is decomposed at the temperature in the primary recrystallization annealing process and can penetrate into the steel sheet. Specifically, the nitriding gas may include one or more of ammonia and amine.

The time to perform the preceding step and the time to perform the subsequent step may be 10 to 80 seconds and 30 to 100 seconds, respectively.

For the crack temperature of the primary recrystallization annealing step, that is, the preceding step and the subsequent step may be performed at a temperature of 800 to 900° C. When the temperature is too low, the primary recrystallization may not occur or the nitridation may not be smoothly performed. When the temperature is too high, the primary recrystallization may grow too large, causing the magnetism to deteriorate.

In the primary recrystallization annealing step, decarburization may also be performed. Decarburization may be performed before, after, or simultaneously with the preceding step and the subsequent step. When the decarburization is performed simultaneously with the preceding step and the subsequent step, the preceding step and the subsequent step may be performed in an atmosphere having an oxidizing ability ($PH_2O/PH_2$) of 0.5 to 0.7. By decarburization, the steel sheet may contain 0.005 wt % or less, more specifically, 0.003 wt % or less of carbon.

After the above-described primary recrystallization annealing step, the steel sheet may include 0.015 to 0.025 wt % of nitrogen. As will be described later, the nitrogen content varies depending on the thickness of the steel sheet, and the above range means an average nitrogen content with respect to the total thickness.

After the primary recrystallization annealing, the steel sheet may satisfy expression 2 below.

$$1 \leq [G_{1/4t}] - [G_{1/2t}] \leq 3 \quad \text{[Expression 2]}$$

(In expression 2, $[G_{1/4t}]$ means an average crystal grain diameter (μm) measured at a ¼ point of the total thickness of the steel sheet, and $[G_{1/2t}]$ means an average crystal grain diameter (μm) measured at a ½ point of the total thickness of the steel sheet.)

When the crystal grains ($G_{1/4t}$) on the surface layer portion grow large, a small amount of secondary recrystals of more than 5 mm are formed, and a very non-uniform secondary recrystallized structure is formed, so that the magnetism may deteriorate. In contrast, when the crystal grains ($G_{1/4t}$) on the surface layer portion grow too small, a large amount of fine secondary recrystals of 5 mm or less are formed, and a large number of secondary recrystallized grains with a deteriorated degree of directness in the Goss orientation are formed, so that the magnetism may deteriorate. More specifically, the value of expression 2 may be 1.2 to 2.7. In this case, the crystal grain diameter means a crystal grain diameter measured with respect to a plane parallel to the rolled surface (ND surface).

After the primary recrystallization annealing, the steel sheet may satisfy the following expression 3.

$$0.003 \leq [N_{tot}] - [N_{1/4t-3/4t}] \leq 0.01 \quad \text{[Expression 3]}$$

(In expression 3, $[N_{tot}]$ means the nitrogen content (wt %) of the entire steel sheet, and $[N_{1/4t-3/4t}]$ means the nitrogen content (wt %) at ¼ to ¾ points of the total thickness of the steel sheet.)

When the nitrogen content inside the steel sheet is too small, that is, when the value of expression 3 is too large, the internal crystal grain growth inhibitory force may be insufficient, and a large number of defects such as a nitrogen outlet on the surface layer portion may occur, a large amount of fine secondary recrystallized grains having a diameter of 5 mm or less may be formed, and the magnetism may deteriorate. When the nitrogen content inside the steel sheet is too high, that is, when the value of expression 3 is too small, the magnetism may deteriorate because the surface layer portion crystal grain growth inhibitory force during the secondary recrystallization annealing process is insufficient or the internal crystal grain growth inhibitory force is excessive.

Next, the primary recrystallization annealing-completed cold-rolled sheet is subjected to secondary recrystallization annealing. The purpose of the secondary recrystallization annealing is, broadly speaking, to form a {110}<001> texture by the secondary recrystallization, impart insulation properties due to the formation of a vitreous film by a reaction between an oxide layer formed during decarburization and MgO, and remove impurities that impair the magnetic characteristics. A method of secondary recrystallization annealing allows the primary recrystals to develop well by maintaining the cold-rolled sheet in a mixed gas of nitrogen and hydrogen to protect a nitride which is a particle growth inhibitor at a temperature increase interval, and remove impurities by maintaining the cold-rolled sheet in a 100% hydrogen atmosphere after the secondary recrystallization is completed.

A grain-oriented electrical steel sheet according to an exemplary embodiment of the present invention improves magnetic characteristics by controlling the ratio of the number of crystal grains having a small particle diameter to the number of crystal grains having a large particle diameter. Specifically, the grain-oriented electrical steel sheet according to an exemplary embodiment of the present invention satisfies the following expression 4.

$$[D_S]/[D_L] \leq 0.1 \quad \text{[Expression 4]}$$

(In expression 4, $[D_S]$ represents the number of crystal grains having a particle diameter of 5 mm or less, and $[D_L]$ represents the number of crystal grains having a particle diameter of more than 5 mm.)

When the value of expression 4 is too large, the crystal grain diameter is non-uniform, so that the magnetic deviation becomes large and the magnetism deteriorates.

More specifically, the value of expression 4 may be 0.09 or less.

Since an alloy composition of the grain-oriented electrical steel sheet according to an exemplary embodiment of the present invention is the same as the alloy composition of the above-described slab except for C and N, a repeated description thereof will be omitted.

Specifically, the grain-oriented electrical steel sheet may include 0.03 to 0.15 wt % of Cr.

The grain-oriented electrical steel sheet may further include 0.1 wt % or less of Ni.

The grain-oriented electrical steel sheet may further include a combined amount of 0.03 to 0.15 wt % of Sn and Sb, and 0.01 to 0.05 wt % of P.

The grain-oriented electrical steel sheet may include 2.5 to 4.0 wt % of Si, 0.005 wt % or less of C, 0.015 to 0.040 wt % of Al, 0.04 to 0.15 wt % of Mn, 0.003 wt % or less of N, 0.01 wt % or less of S, 0.03 to 0.15 wt % of Cr, the balance Fe and other impurities that are inevitably mixed.

An iron loss (W17/50) may be 0.80 W/kg or less under 1.7 Tesla and 50 Hz conditions of the grain-oriented electrical steel sheet. More specifically, the iron loss (W17/50) may be 0.60 to 0.75 W/kg. In this case, a thickness standard is 0.18 mm. A magnetic flux density (B8) of the grain-oriented electrical steel sheet induced under a magnetic field of 800 Nm may be 1.92 T or more. More specifically, the magnetic flux density may be 1.93 to 1.95T.

Hereinafter, preferred examples and comparative examples of the present invention will be described. However, the following examples are merely a preferred example of the present invention, and the present invention is not limited to the following examples.

EXAMPLE

A slab containing 3.15 wt % of Si, 0.045 wt % of C, 0.02 wt % of P, 0.05 wt % of Sn, 0.1 wt % of Mn, 0.005 wt % of S, 0.03 wt % of sol Al, 0.004 wt % of N, 0.08 wt % of Cr, and the balance Fe and other impurities that are inevitably contained as the other components was produced. Thereafter, a hot-rolled sheet having a thickness of 1.8 mm was produced by heating the slab at a temperature of 1180° C. for 210 minutes, and then hot-rolling the slab.

After the hot-rolled sheet was heated to 1050° C., and then maintained at 950° C. for 90 seconds, the hot-rolled sheet was subjected to furnace cooling to 760° C., quenched in boiling water at 100° C., washed with acid, and then strongly cold-rolled to a thickness of 0.18 mm once.

The cold-rolled sheet was subjected to simultaneous decarburization and nitridation annealing heat treatment, such that the carbon content and the nitrogen content were 30 ppm or less and 200 ppm, respectively in a mixed gas atmosphere of moist oxygen (oxidation degree about 0.6), nitrogen, and ammonia at a temperature of about 850° C. In this case, the amount of nitriding gas introduced in a preceding step and the amount of nitriding gas introduced in a subsequent step were adjusted as shown in the following Table 1, and the preceding step and the subsequent step were performed for 50 seconds and 70 seconds, respectively.

Further, the crystal grain diameter and nitrogen content of the primary recrystallization annealing-completed steel sheet were analyzed and are summarized in the following Table 1.

This steel sheet was finally annealed in a coil shape by applying an annealing separator MgO to the steel sheet. The final annealing was performed in a mixed atmosphere of 25 v % nitrogen and 75 v % hydrogen until 1200° C., and when the temperature reached 1200° C., the steel sheet was maintained in a 100 v % hydrogen atmosphere for 10 hours or more, and then furnace-cooled. Table 1 shows the magnetic characteristics and structural characteristics measured under each condition.

For magnetism, iron loss was measured under the conditions of 1.7 Tesla and 50 Hz using a single sheet measurement method, and the magnitude of magnetic flux density (Tesla) induced under a magnetic field of 800 Nm was measured. Each magnetic flux density and iron loss value show the average under each condition.

TABLE 1

| | | Steel sheet after primary recrystallization annealing | | Magnetic characteristics | | | |
|---|---|---|---|---|---|---|---|
| | | $[G_{1/4t}]$ − | $[N_{tot}]$ − | | | | |
| Classification | [A]/[B] | $[G_{1/2t}]$ (μm) | $[N_{1/4t-3/4t}]$ (ppm) | B8 (Tesla) | W 17/50 (W/Kg) | $[D_S]/[D_L]$ | Remark |
| Invention Material 1 | 0.15 | 1.3 | 35 | 1.93 | 0.7 | 0.08 | — |
| Invention Material 2 | 0.1 | 2 | 60 | 1.939 | 0.67 | 0.06 | — |
| Invention Material 3 | 0.06 | 2.5 | 100 | 1.935 | 0.68 | 0.07 | — |
| Invention Material 4 | 0.1 | 1.5 | 50 | 1.92 | 0.7 | 0.10 | Cr not added |
| Comparative Material 1 | 0.25 | 0.5 | 50 | 1.905 | 0.81 | 0.15 | — |
| Comparative Material 2 | 0.01 | 2.8 | 110 | 1.895 | 0.88 | 0.34 | — |

As can be confirmed in Table 1, it can be confirmed that because Invention Materials 1 to 4 in which the nitriding gas was controlled in the primary recrystallization annealing process had the surface layer crystal grains grown appropriately and appropriate nitridation into the inside of the steel sheet, the formation of secondary recrystals of less than 5 mm was suppressed and the magnetism was excellent.

In contrast, in Comparative Material 1 in which a large amount of nitriding gas was introduced in the preceding step, the surface layer crystal grains were formed too small, so that a large amount of fine secondary recrystals were formed and the magnetism also deteriorated.

In addition, Comparative Material 2 in which the nitriding gas was soaked too much in the preceding step had too little nitrogen content inside the steel sheet, so that a large amount of fine secondary recrystals were formed and the magnetism also deteriorated.

The present invention is not limited to the embodiments, and can be manufactured in various different forms, and those having ordinary skill in the art to which the present invention pertains will understand that the present invention can be implemented in other specific forms without changing the technical idea or essential features thereof. Therefore, it should be understood that the above-described embodiments are illustrative and not restrictive in all aspects.

The invention claimed is:

1. A grain-oriented electrical steel sheet satisfying the following Expression 4:

$$0.06 \leq [D_S]/[D_L] \leq 0.1 \quad \text{[Expression 4]}$$

wherein $[D_S]$ represents the number of crystal grains having a particle diameter of 5 mm or less, and $[D_L]$ represents the number of crystal grains having a particle diameter of more than 5 mm.

2. The grain-oriented electrical steel sheet of claim 1, wherein:

the steel sheet comprises 0.03 to 0.15 wt % of Cr.

* * * * *